US011066135B1

(12) United States Patent
Wang

(10) Patent No.: US 11,066,135 B1
(45) Date of Patent: Jul. 20, 2021

(54) WAVE-GENERATING WATERCRAFT WITH A WAVE FORMING FIN

(71) Applicant: Hudson Wang, Kaohsiung (TW)

(72) Inventor: Hudson Wang, Kaohsiung (TW)

( * ) Notice: Subject to any disclaimer, the term of this patent is extended or adjusted under 35 U.S.C. 154(b) by 0 days.

(21) Appl. No.: 16/875,128

(22) Filed: May 15, 2020

(51) Int. Cl.
*B63B 34/75* (2020.01)

(52) U.S. Cl.
CPC ..... *B63B 34/75* (2020.02)

(58) Field of Classification Search
CPC ..... B63B 34/75; B63B 34/70; B63B 32/00; B63B 32/20; B63B 35/00
See application file for complete search history.

(56) References Cited

U.S. PATENT DOCUMENTS 3,463,109 A * 8/1969 Weiler ..... B63B 39/061 114/286
2014/0261135 A1* 9/2014 Gasper ..... G08G 3/00 114/284
2020/0385092 A1* 12/2020 Eberhardt ..... B60N 2/5685

FOREIGN PATENT DOCUMENTS

WO WO-2019120350 A1 * 6/2019 ..... B63B 32/70

* cited by examiner

*Primary Examiner* — Stephen P Avila
(74) *Attorney, Agent, or Firm* — McNees Wallace & Nurick LLC

(57) ABSTRACT

A wave-generating watercraft includes a craft body having an installation space receiving a wave-generating unit. A telescopic drive is mounted within the installation space and is connected to a driven unit. A wave-forming fin is connected to the driven unit and is driven by the telescopic drive to move between extended and retracted positions. The telescopic drive is aligned with a front-rear direction of the craft body and is stretchable and retractable along the front-rear direction. The wave-forming fin protrudes from the installation space when the wave-forming fin moves to the extended position and is received in the installation space when the wave-forming fin retracts.

3 Claims, 5 Drawing Sheets

WAVE-GENERATING WATERCRAFT WITH A WAVE FORMING FIN

FIELD

The disclosure relates to a watercraft, and more particularly to a wave-generating watercraft.

BACKGROUND

As shown in FIG. 1, an existing wave-generating watercraft 1 includes a craft body 10 and two wave-generating units 11 mounted to a stern of the craft body 10. Each wave-generating unit 11 includes a telescopic rod 111 connected to the craft body 10, and a fin plate 112 connected to an end of the telescopic rod 111. When the craft body 10 travels through water, the telescopic rod 111 actuates the fin plate 112 to generate waves for water sporting.

Although the wave-generating units 11 are disposed outside the craft body 10 to save an interior space of the craft body 10 for accommodating accessories, the wave-generating units 11, which protrude outward from the craft body 10, can adversely affect the aesthetic quality of the craft body 10. Further, because the wave-generating units 11 extend down into the body of water, they are prone to collision with underwater rocks, barriers or the like.

Referring to FIG. 2, another existing wave-generating watercraft 2 includes a craft body 20 having two installation spaces 200 (only one shown) respectively formed in two sides of the craft body 20, and two wave-generating units 21 respectively mounted in the installation spaces 200. Each wave-generating unit 21 includes a telescopic drive 211 extendable transversely to a front-rear direction of the craft body 20, and a wave-forming wing plate 212 pivoted to the craft body 20 and connected to the telescopic drive 211. The wing plate 212 is driven by the telescopic drive 211 to move between a retracted position to be received in the installation space 200, and an extended position to protrude outwardly from the installation space 200 relative to the craft body 20. When the craft body 20 travels through water, the wing plate 212 can be pushed outward by the telescopic drive 211 to generate waves.

While the wave-generating watercraft 2 can solve aesthetic and collision problems due to the retractable wing plate 212, the craft body 20 has to reserve an extra space to allow the telescopic drive 211 to move in a direction transverse to the front-rear direction, thereby affecting spatial arrangement for equipment and usage of an interior space in the craft body 20.

SUMMARY

Therefore, an object of the disclosure is to provide a wave-generating watercraft with a wave-forming fin that takes less space for performing operating activities and that is simplified in structure.

According to the disclosure, a wave-generating watercraft includes a craft body and at least one wave-generating unit.

The craft body has front and rear ends, two opposite sides each extending between the front and rear ends, and at least one installation space formed in at least one of the opposite sides.

The at least one wave-generating unit is mounted within the at least one installation space, and includes a telescopic drive, a driven unit and a wave-forming fin.

The telescopic drive is mounted to the craft body within the at least one installation space and is aligned with a front-rear direction of the craft body. The telescopic drive is stretchable and retractable along the front-rear direction.

The driven unit is pivotally connected to the telescopic drive to transmit an actuation force from the telescopic drive.

The wave-forming fin is connected to the driven unit and is driven by the telescopic drive to move between an extended position and a retracted position.

When the wave-forming fin moves to the extended position, the wave-forming fin protrudes outwardly from the at least one installation space and is oblique to the front-rear direction of the craft body.

When the wave-forming fin moves to the retracted position, the wave-forming fin is moved to and is received in the at least one installation space.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 3:
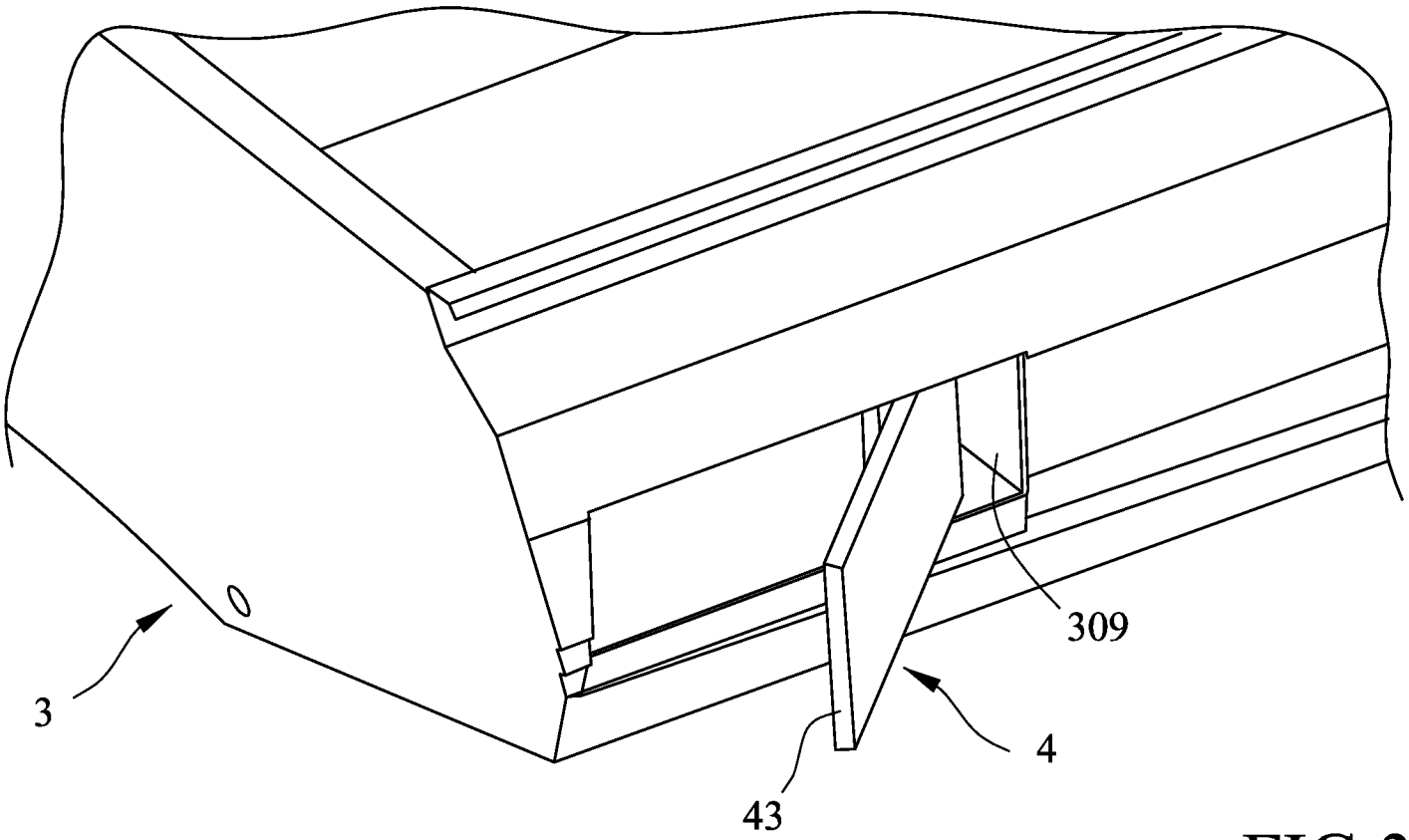
FIG. 3 is a fragmentary perspective view illustrating a wave-generating watercraft according to an embodiment of the disclosure.
Figure 4:
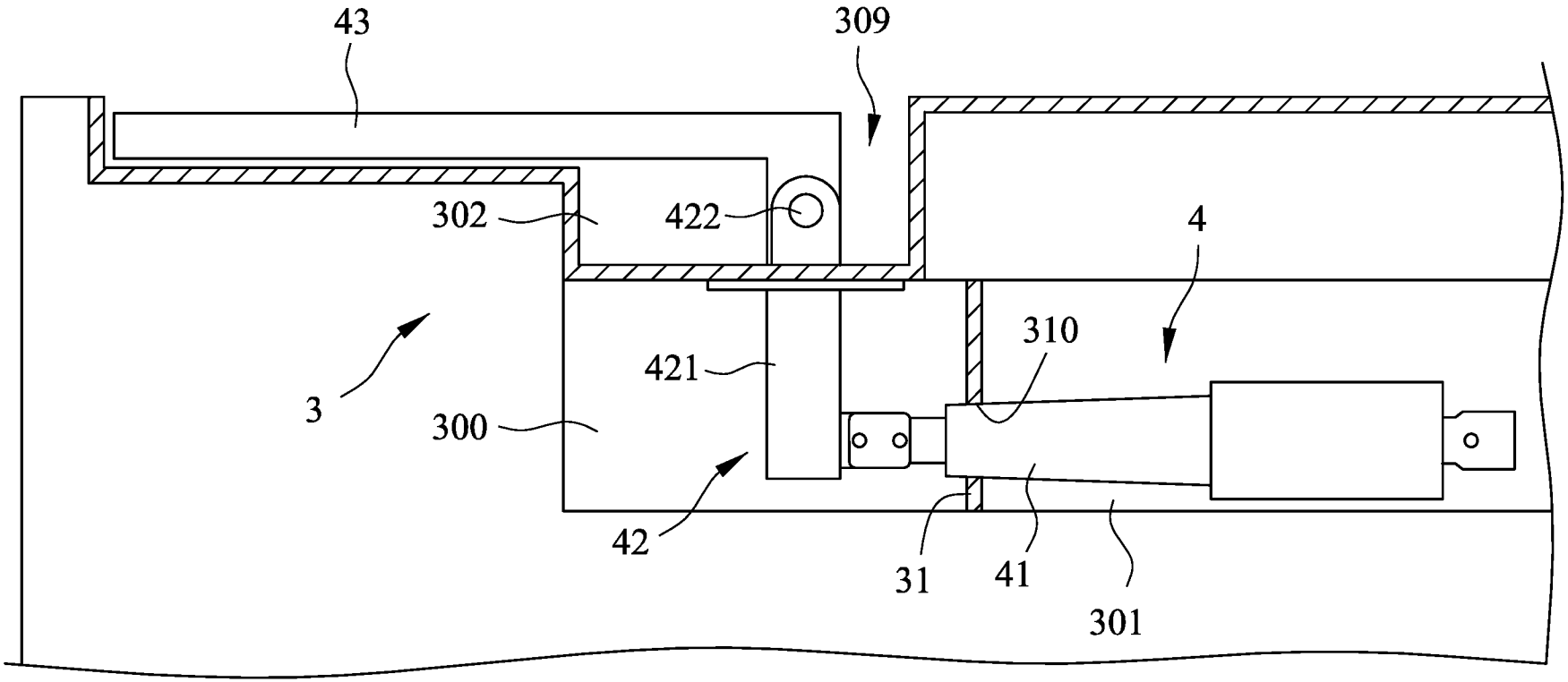
FIG. 4 is a top sectional view illustrating a wave-forming fin of the embodiment at a retracted position.

FIGS. 3 and 4 illustrate a wave-generating watercraft according to an embodiment of the disclosure. The wave-generating watercraft includes a craft body 3 and two wave-generating units 4 (only one shown). The craft body 3 has front and rear ends, two opposite sides (only one shown) each extending between the front and rear ends, and two installation spaces 300 (only one shown) respectively formed in the opposite sides of the craft body 3. The wave-generating units 4 are respectively mounted within the installation spaces 300. While the wave-generating units 4 are respectively mounted within the installation spaces 300 in this embodiment, the wave-generating watercraft of the disclosure may have multiple wave-generating units 4 arranged on one of the two opposite sides of the craft body 3. Hereinafter, only one wave-generating unit 4 in one installation space 300 is exemplified.

Each installation space 300 has an opening 309, a longitudinal space 301 and a transverse space 302. The opening 309 opens outwardly at the respective side of the craft body 3. The longitudinal space 301 is distal to the opening 309. The transverse space 302 communicates with the longitudinal space 301 and the opening 309. Further, the craft body 3 has two water fences 31 (only one shown). Each water fence 31 adjoins the longitudinal space 301 within a respective one of the installation spaces 300 and has a through hole 310. Each water fence 31 can provide a water sealing effect to the longitudinal space 301.

Figure 5:
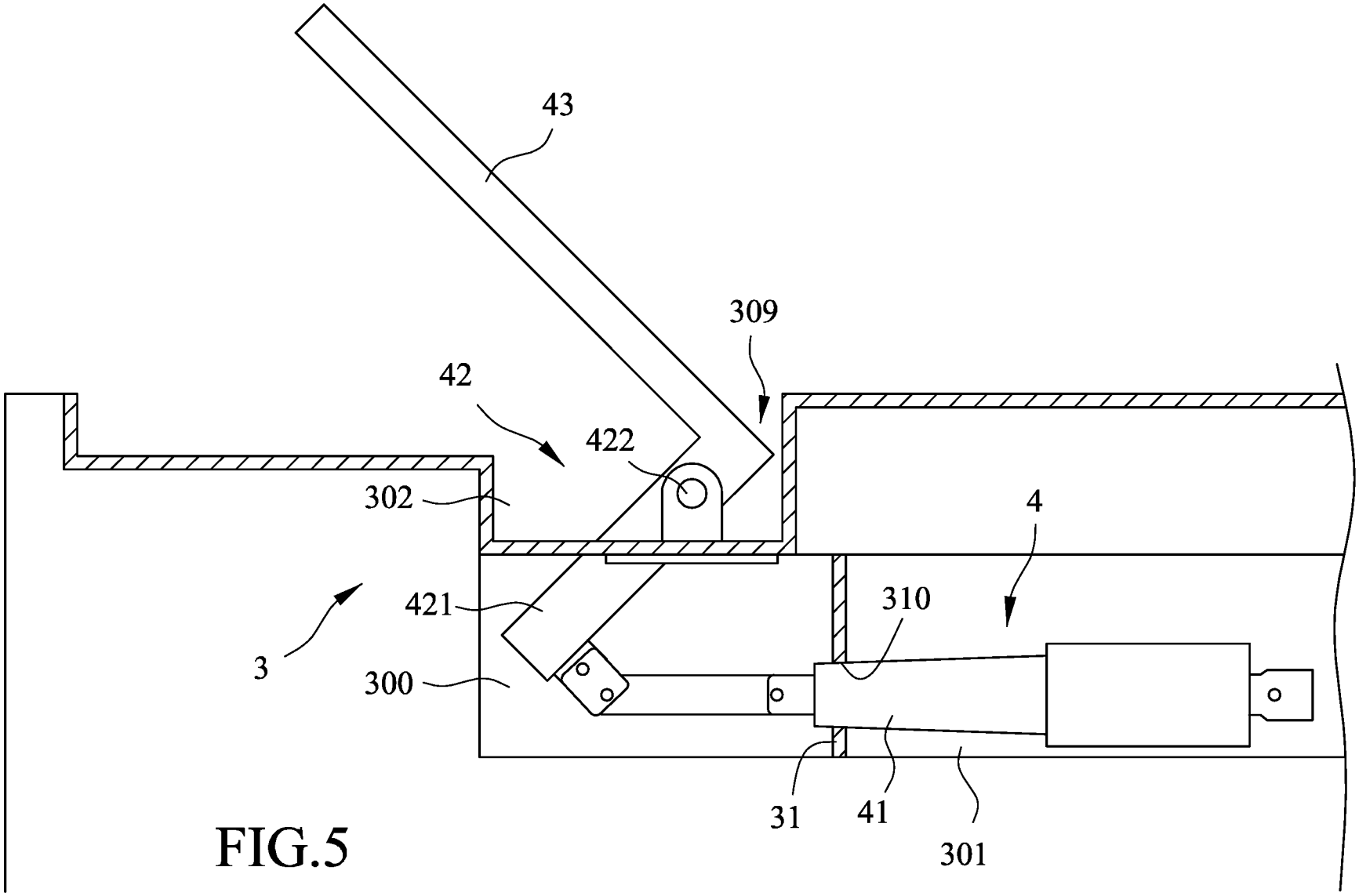
FIG. 5 is a view similar to FIG. 4, but illustrating the wave-forming fin at an extended position.

Referring to FIG. 5 in combination with FIGS. 3 and 4, the wave-generating unit 4 includes a telescopic drive 41, a driven unit 42 and a wave-forming fin 43. The telescopic drive 41 is mounted to the craft body 3, is received in the longitudinal space 301, and is aligned with a front-rear direction of the craft body 3. The telescopic drive 41 is stretchable and retractable along the front-rear direction through the through hole 310 of the water fence 31. The water fence 31 prevents water from adversely affecting the function of the telescopic drive 41. The driven unit 42 is pivotally connected to the telescopic drive 41 to transmit an actuation force from the telescopic drive 41, and is received in the transverse space 302. The wave-forming fin 43 is connected to the driven unit 42 and is driven by the telescopic drive 41 to move between an extended position and a retracted position.

In this embodiment, the driven unit 42 includes a fulcrum seat 422 and a driven rod 421. The fulcrum seat 422 is mounted on the craft body 3 within the transverse space 302. The driven rod 421 has two opposite rod ends respectively connected to the telescopic drive 41 and the wave-forming fin 43. The driven rod 421 is fulcrummed on the fulcrum seat 422 between its two opposite rod ends and is pivotal to move the wave-forming fin 43 between the extended and retracted positions. To create waves during travel of the wave-generating watercraft, the telescopic drive 41 is actuated and stretched to push one of the rod ends of the driven rod 421 which is away from the wave-forming fin 43. The driven rod 421 pivots about the fulcrum seat 422 to move the wave-forming fin 43. When the wave-forming fin 43 moves to the extended position, the wave-forming fin 43 protrudes outwardly from the installation space 300 and is oblique to the front-rear direction of the craft body 3. The wave-forming fin 43 can interact with water forces to generate waves. When the telescopic drive 41 retracts, the wave-forming fin 43 is moved by the driven rod 421 to the retracted position. When the wave-forming fin 43 moves to the retracted position, the wave-forming fin 43 is moved to and received in the installation space 300. The wave-forming fin 43 at the retracted position spans the opening 309.

As the telescopic drive 41 stretches and retracts along the front-rear direction within the longitudinal space 301, the longitudinal space 301 that is elongated along the front-rear direction can be small in width. Therefore, the craft body 3 need not reserve an extra space that is enlarged in a direction toward an interior part of the craft body 3, and an interior space of the craft body 3 can be saved for accommodating accessories. In addition, when the wave-forming fin 43 is at the retracted position, not only is the craft body 3 aesthetic, but damages due to collision are also avoided.

Figure 1:
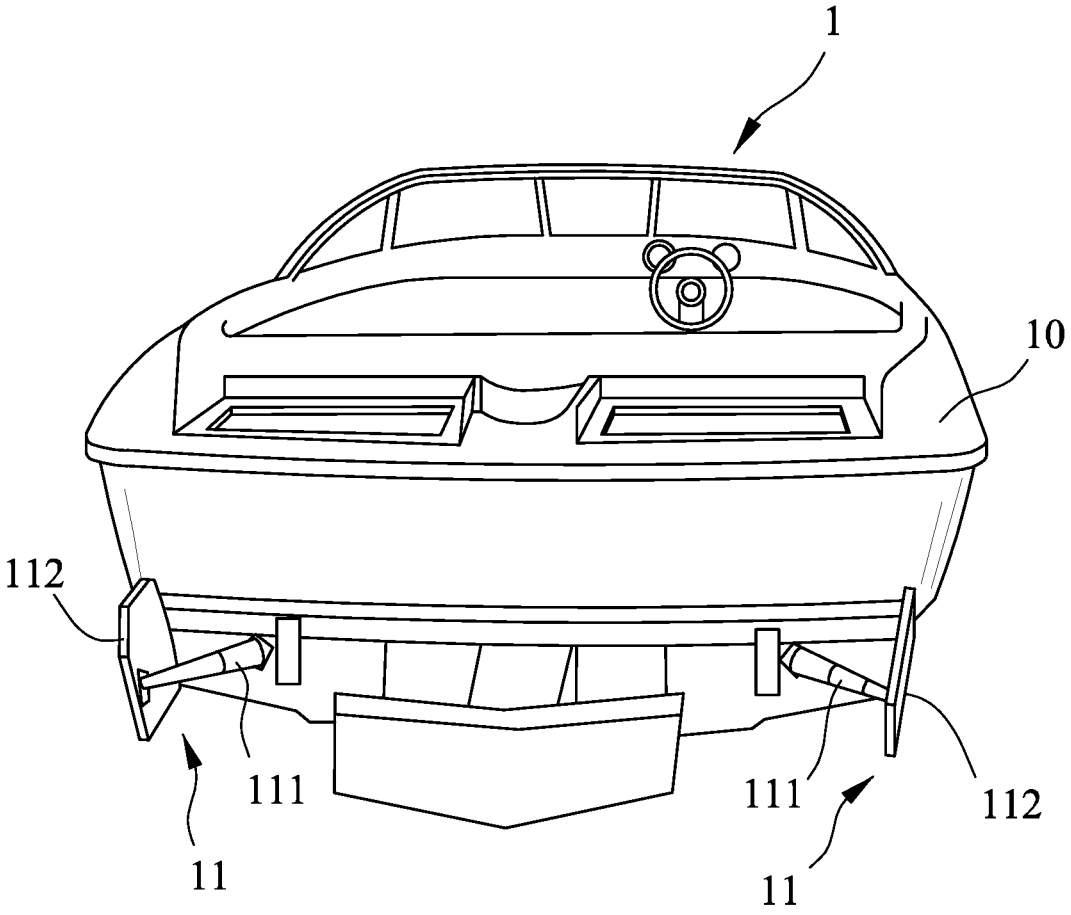
FIG.1 PRIOR ART
FIG. 1 is a perspective view illustrating an exiting wave-generating watercraft.
Figure 2:
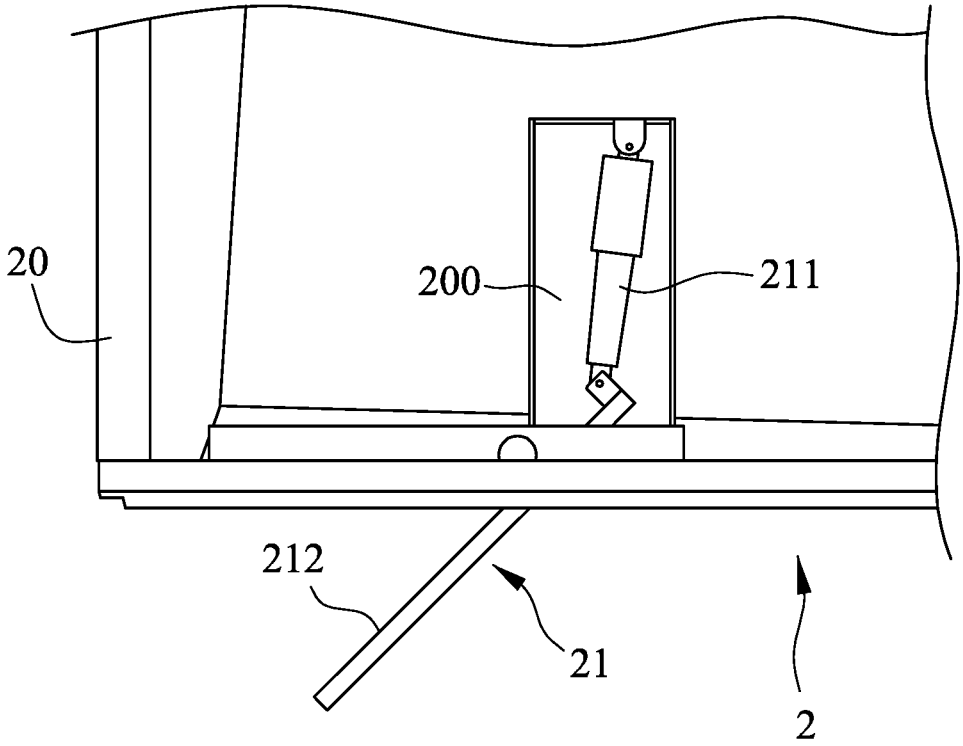
FIG.2 PRIOR ART
FIG. 2 is a fragmentary top sectional view illustrating another existing wave-generating watercraft.

Compared to the telescopic drive 211 of the prior art (see FIG. 2), the telescopic drive 41 of the disclosure is changed in orientation and stretching and retracting directions thereof so that the longitudinal space 301 to receive the telescopic drive 41 need not extend too much into the interior part of the craft body 3 from the outer side thereof. An interior space of the craft body 3 can thus be saved for accommodating accessories.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A wave-generating watercraft, comprising:

a craft body having front and rear ends, two opposite sides each extending between said front and rear ends, and at least one installation space formed in at least one of said opposite sides; and at least one wave-generating unit mounted within said at least one installation space, and including a telescopic drive mounted to said craft body within said at least one installation space and aligned with a front-rear direction of said craft body, said telescopic drive being stretchable and retractable along the front-rear direction, a driven unit pivotally connected to said telescopic drive to transmit an actuation force from said telescopic drive, and a wave-forming fin connected to said driven unit and driven by said telescopic drive to move between an extended position and a retracted position, wherein, when said wave-forming fin moves to the extended position, said wave-forming fin protrudes outwardly from said at least one installation space and is oblique to the front-rear direction of said craft body, wherein, when said wave-forming fin moves to the retracted position, said wave-forming fin is moved to and received in said at least one installation space, wherein said at least one installation space has an opening that opens outwardly at said at least one of said two opposite sides of said craft body, wherein said wave-forming fin at the retracted position spans said opening, wherein said at least one installation space further has a longitudinal space to receive said telescopic drive, and a transverse space that communicates with said longitudinal space and said opening to receive said driven unit, and wherein said craft body further has a water fence that adjoins said longitudinal space within said at least one installation space and that has a through hole for passage of said telescopic drive.

2. The wave-generating watercraft as claimed in claim 1, wherein said at least one installation space includes two installation spaces respectively formed in said two opposite sides of said craft body; and said at least one wave-generating unit includes two wave-generating units respectively mounted within said installation spaces.

3. The wave-generating watercraft as claimed in claim 1, wherein said driven unit includes a fulcrum seat and a driven rod, said fulcrum seat being mounted on said craft body within said at least one installation space, said driven rod that has two opposite rod ends respectively connected to said telescopic drive and said wave-forming fin and that is fulcrummed on said fulcrum seat between said two opposite rod ends, said driven rod being pivotal to move said wave-forming fin between the extended and retracted positions.

* * * * *